US012091959B2

(12) United States Patent
Madasu et al.

(10) Patent No.: US 12,091,959 B2
(45) Date of Patent: Sep. 17, 2024

(54) MULTI-WELL DRILLING OPTIMIZATION USING ROBOTICS

(71) Applicant: Landmark Graphics Corporation, Houston, TX (US)

(72) Inventors: Srinath Madasu, Houston, TX (US); Shashi Dande, Spring, TX (US); Keshava Prasad Rangarajan, Sugarland, TX (US)

(73) Assignee: Landmark Graphics Corporation, Houston, TX (US)

( * ) Notice: Subject to any disclaimer, the term of this patent is extended or adjusted under 35 U.S.C. 154(b) by 270 days.

(21) Appl. No.: 17/616,227

(22) PCT Filed: Jul. 10, 2019

(86) PCT No.: PCT/US2019/041199
§ 371 (c)(1),
(2) Date: Dec. 3, 2021

(87) PCT Pub. No.: WO2021/006896
PCT Pub. Date: Jan. 14, 2021

(65) Prior Publication Data
US 2022/0235645 A1 Jul. 28, 2022

(51) Int. Cl.
*E21B 44/02* (2006.01)

(52) U.S. Cl.
CPC ..... *E21B 44/02* (2013.01); *E21B 2200/22* (2020.05)

(58) Field of Classification Search
CPC ..... E21B 44/02; E21B 44/04; E21B 44/06; E21B 2200/22
See application file for complete search history.

(56) References Cited

U.S. PATENT DOCUMENTS

2005/0060096 A1* 3/2005 Hutchinson ..... E21B 44/00 702/6
2013/0066471 A1* 3/2013 Wang ..... G05B 13/024 700/275

(Continued)

OTHER PUBLICATIONS

Berkenkamp et al., "Bayesian Optimization with Safety Constraints: Safe and Automatic Parameter Tuning in Robotics", Learning & Adaptive Systems Group, Department of Computer Science, Feb. 14, 2016, 9 pages.

(Continued)

*Primary Examiner* — Christopher J Sebesta
(74) *Attorney, Agent, or Firm* — Kilpatrick Townsend & Stockton LLP

(57) ABSTRACT

A system and method for controlling multiple drilling tools inside wellbores makes use of Bayesian optimization with range constraints. A computing device samples observed values for controllable drilling parameters such as weight-on-bit, mud flow rate and drill bit rotational speed in RPM and evaluates a selected drilling parameter such a rate-of-penetration and hydraulic mechanical specific energy for the observed values using an objective function. Range constraints including the physical drilling environment and the total power available to all drilling tools within the drilling environment can be continuously learned by the computing device as the range constraints change. A Bayesian optimization, subject to the range constraints and the observed values, can produce an optimized value for the controllable drilling parameters to achieve a predicted value for the drilling parameters. The system can then control the drilling tool using the optimized value to achieve the predicted value for the selected drilling parameter.

18 Claims, 7 Drawing Sheets

(56) References Cited

U.S. PATENT DOCUMENTS

| | | | | |
|---|---|---|---|---|
| 2014/0277752 | A1* | 9/2014 | Chang | E21B 44/00 700/275 |
| 2017/0051598 | A1* | 2/2017 | Ouenes | G06F 30/20 |
| 2017/0146006 | A1 | 5/2017 | Robison et al. | |
| 2018/0087360 | A1 | 3/2018 | Conn et al. | |
| 2018/0171756 | A1 | 6/2018 | Adolph et al. | |
| 2018/0171774 | A1* | 6/2018 | Ringer | E21B 47/002 |
| 2019/0024501 | A1 | 1/2019 | Borgos et al. | |

OTHER PUBLICATIONS

International Application No. PCT/US2019/041199, International Search Report and Written Opinion, mailed Apr. 8, 2020, 10 pages.

Snoek et al., "Scalable Bayesian Optimization Using Deep Neural Networks", Harvard University, School of Engineering and Applied Sciences, arXiv:1502.05700v2 [stat.ML], Jul. 13, 2015, 13 pages.

* cited by examiner

MULTI-WELL DRILLING OPTIMIZATION USING ROBOTICS

TECHNICAL FIELD

The present disclosure relates generally to wellbore drilling. More specifically, but not by way of limitation, this disclosure relates to real-time control of multiple drilling tools during wellbore drilling.

BACKGROUND

A well includes a wellbore drilled through a subterranean formation. The conditions inside the subterranean formation where the drill bit is passing when the wellbore is being drilled continuously change. For example, the formation through which a wellbore is drilled exerts a variable force on the drill bit. This variable force can be due to the rotary motion of the drill bit, the weight applied to the drill bit, and the friction characteristics of each strata of the formation. A drill bit may pass through many different materials, rock, sand, shale, clay, etc., in the course of forming the wellbore and adjustments to various drilling parameters are sometimes made during the drilling process by a drill operator to account for observed changes.

DETAILED DESCRIPTION

Figure 1:
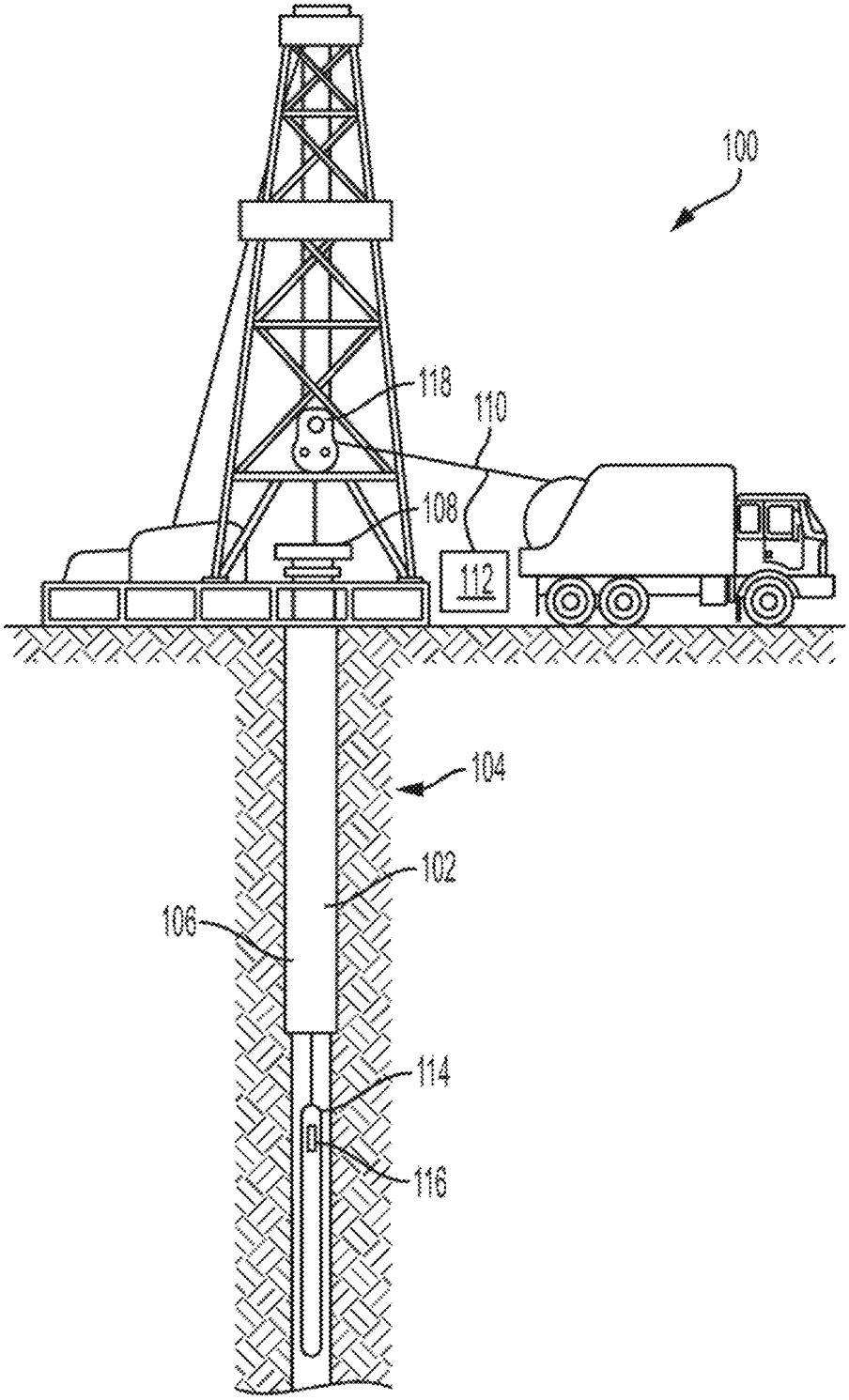
FIG. 1 is a cross-sectional view of an example of a well system that includes a computing device for controlling a drilling tool according to some aspects.

Certain aspects and features relate to a system that improves, and makes more efficient, drilling optimization using multi-agent (MA) programming to drill multiple wells, the use of multi-objective (MO) to optimize surface energy consumption, and maximizing rate of penetration (ROP) using robotics to control drillbots. Described aspects aid in fast and efficient computation of optimum well drilling parameters such as weight on bit (WOB), mud flow rate (Q) and rotations per minute (RPM); and further utilizing the parameters for real time prediction and optimized closed loop automation control of multiple wells within a drilling environment.

Certain aspects include a MAMOBO (Multi-Agent Multi-Objective Bayesian Optimization) methods and systems for carrying out methods of identifying optimum parameters for multi-well multi-objective drilling using robotics with fast, robust and accurate prediction. The various methods minimize surface energy consumption and maximize ROP by wells within the multi-well environment. A Bayesian optimization (BO) is used for optimization and it converges to the correct set of parameters in an automated process. These methods can use historical sensor data to quickly drive the optimization process to an accurate solution of well operations parameters. Real-time down hole sensor values can be used for future predictions and training of a prediction model.

Multi-agents include multiple computing devices that can perform different tasks of a common process such as ROP model generation, hydraulic mechanical specific energy (HMSE) computation and optimization of these drilling parameters individually and with regard to overall power availability for a drilling environment. The optimization is thus multi-objective because there are multiple stages of optimization including both local and global optimization. Each of the agents can be deployed on a robotic operating system (ROS and provide robotics controlling various drilling tools with optimized drilling parameters to improve performance and output of drilling operations.

Each drilling tool (e.g., a well system) is controlled by a robot such as a drillbot, which receives control signals from a multi-agent corresponding to the drilling tool. These multi-agents operate in the ROS environment. ROS is a flexible multi-node/agent framework for writing distributed peer to peer robotic software. ROS provides tools, libraries, and conventions that enable operations for complex and robust drillbot behavior. The robotic platform consists of sensors, actuators and the multi-agent, multi-objective based closed loop optimization software.

In some examples, observations during optimization can be used to update a machine learning model for predicting future values of selected drilling parameters. Certain aspects and features use Bayesian optimization while continuously learning and taking into account range constraints imposed by the physical characteristics of the drilling setup and formation across a number of wells, to quickly and accurately project optimum controllable drilling parameters for drilling optimization in individual wells and, or clusters of wells within a drilling environment. The system can project optimized controllable drilling parameters with less computing power and storage and can thus drive optimization faster and over an entire drilling environment rather than merely on an individual well system basis. Additionally, the system is more likely to converge to the correct solution.

In some examples, a system includes multiple drilling tools and computing devices in communication with the respective drilling tools. The computing devices can include instructions that are executable by the computing devices to cause the computing devices to sample observed values for multiple controllable drilling parameters and evaluate a selected drilling parameter for the observed values using an objective function. Engineering constraints can be evaluated by the computing device to determine range constraints. A Bayesian optimization process, subject to the range constraints including both engineering constraints and power constraints, and the observed values, can be run to produce an optimized value for each of the controllable drilling parameters to achieve a predicted value for the selected drilling parameters. The system can then apply the optimized values for the controllable drilling parameters to the drilling tools to achieve the predicted value for the selected drilling parameters.

FIG. 1 is a cross-sectional side view of an example of a well system 100 according to some aspects. The well system 100 includes a wellbore 102 extending through a hydrocarbon bearing subterranean formation 104. In this example, the wellbore 102 is vertical, but in other examples, the wellbore 102 can additionally or alternatively be horizontal or deviated.

In this example, the wellbore 102 includes a casing string 106 (e.g., a metal casing) extending from the well surface 108 into the subterranean formation 104. The casing string 106 can provide a conduit via which formation fluids, such as production fluids produced from the subterranean formation 104, can travel from the wellbore 102 to the well surface 108. In other examples, the wellbore 102 can lack the casing string 106.

The wellbore 102 can include a drilling tool 114 for extending the wellbore 102. Additional tools can also be included, such as a safety tool, valve tool, packer tool, monitoring tool, formation-testing tool, a logging-while-drilling tool, or any combination of these. In some examples, a tool is deployed in the wellbore 102 using a wireline 110, slickline, or coiled tube, which can be wrapped around a winch 118 or pulley at the well surface 108.

The well system 100 can also include a computing device 112, which may host a drillbot or other robot configured to control operations of the well system 100 using control signals and various actuators of the well system components. The computing device 112 can be positioned at the well surface 108 or elsewhere (e.g., offsite). The computing device 112 may be in communication with the drilling tool 114, a sensor, or another electronic device. For example, the computing device 112 can have a communication interface for transmitting information to and receiving information from another communication interface 116 of the drilling tool 114.

In some examples, the computing device 112 can receive information from downhole (or elsewhere) in substantially real time, which can be referred to as real-time data. The real-time data can include information related to the well system 100. For example, the drilling tool 114 can stream real-time data to the computing device 112, where the real-time data includes information about the orientation or location of the drilling tool 114 in the wellbore 102, or the ROP, WOB, Q, or rotational speed of the drilling tool 114 through the wellbore 102. The computing device 112 can use the real-time data at least in part to teach a deep-learning neural network and supply observed values to an optimizer, which a well operator may use to determine one or more controllable parameters for performing an operation in the well system 100. For example, the computing device 112 can use the real-time data to teach a deep-learning neural network optimizer that can be used for Bayesian optimization to provide a predicted value for a selected drilling parameters such as ROP for the drilling tool 114 through the subterranean formation 104. The Bayesian optimization can also provide predicted controllable parameters to be applied to drilling tool 114. A more specific example of the computing device 112 is described in greater detail below with respect to FIG. 2.

Figure 2:
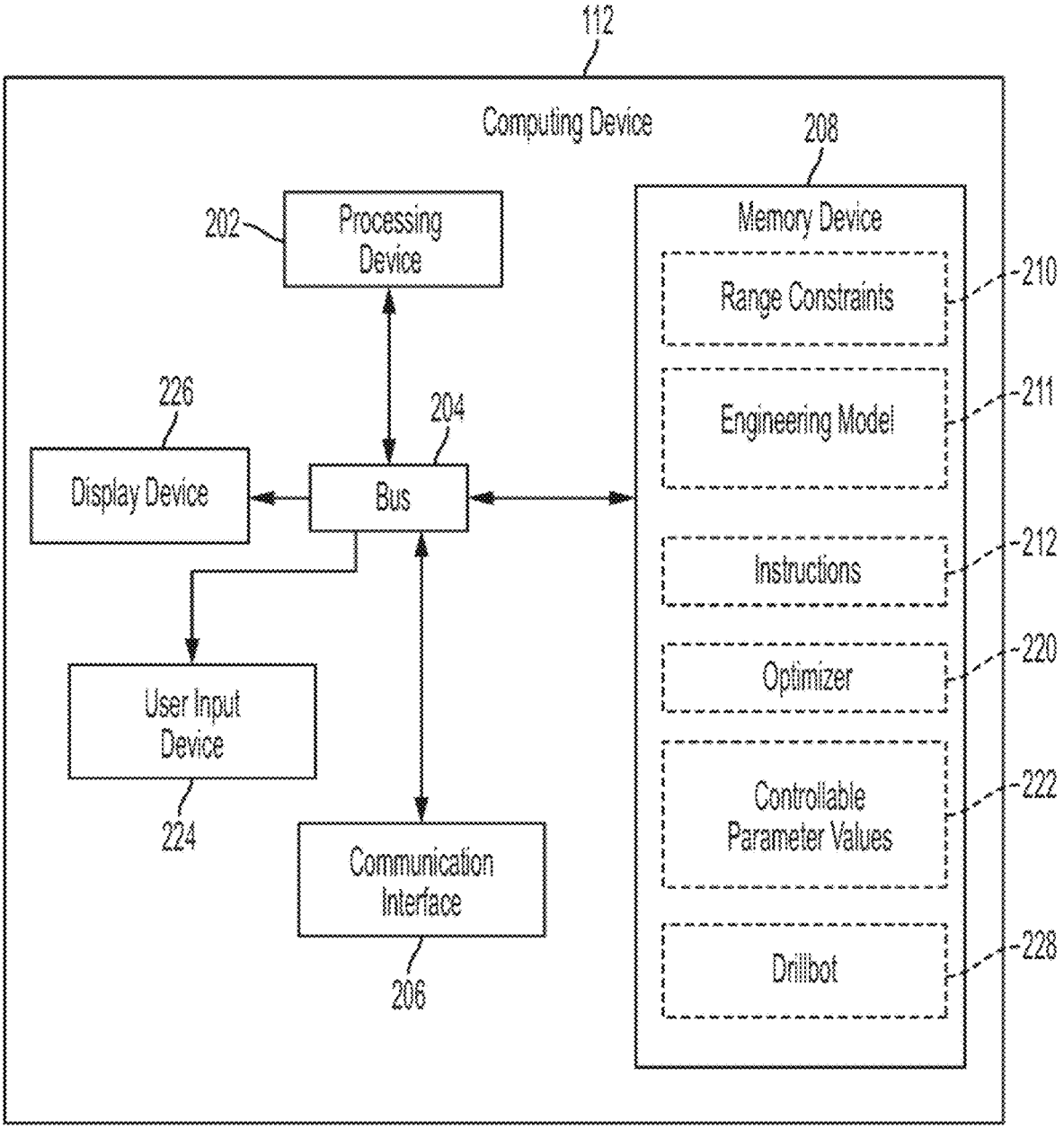
FIG. 2 is block diagram of a computing device for controlling a drilling tool according to some aspects of the disclosure.

FIG. 2 depicts an example of a computing device 112. The computing device 112 can include a processing device 202, a bus 204, a communication interface 206, a memory device 208, a user input device 224, and a display device 226. In some examples, some or all of the components shown in FIG. 2 can be integrated into a single structure, such as a single housing. In other examples, some or all of the components shown in FIG. 2 can be distributed (e.g., in separate housings) and in communication with each other.

The processing device 202 can execute one or more operations for optimizing parameters for controlling a wellbore operation. The processing device 202 can execute instructions stored in the memory device 208 to perform the operations. The processing device 202 can include one processing device or multiple processing devices. Non-limiting examples of the processing device 202 include a field-programmable gate array ("FPGA"), an application-specific integrated circuit ("ASIC"), a microprocessing device, etc.

The processing device 202 can be communicatively coupled to the memory device 208 via the bus 204. The non-volatile memory device 208 may include any type of memory device that retains stored information when powered off. Non-limiting examples of the memory device 208 include electrically erasable and programmable read-only memory ("EEPROM"), flash memory, or any other type of non-volatile memory. In some examples, at least some of the memory device 208 can include a non-transitory computer-readable medium from which the processing device 202 can read instructions. A computer-readable medium can include electronic, optical, magnetic, or other storage devices capable of providing the processing device 202 with computer-readable instructions or other program code. Non-limiting examples of a computer-readable medium include (but are not limited to) magnetic disk(s), memory chip(s), read-only memory (ROM), random-access memory ("RAM"), an ASIC, a configured processing device, optical storage, or any other medium from which a computer processing device can read instructions. The instructions can include processing device-specific instructions generated by a compiler or an interpreter from code written in any suitable computer-programming language, including, for example, C, C++, C#, etc.

In this example, the memory device 208 includes range constraints 210. The memory device 208 in this example also includes an engineering model 211 to provide engineering constraints imposed by the drilling environment that can be accessed and used to continuously determine, evaluate, and learn the range constraints. In this example, the memory device 208 includes computer program instructions 212 for acquiring data and controlling the drilling tool 114. The memory device 208 in this example includes an optimizer 220, which can be a component or module of a distributed optimization system utilizing multiple computing devices of drilling tools to optimize parameters of the various drilling tools. The optimizer can be, for example, computer program code instructions to implement a deep-learning neural network to perform Bayesian optimization of the selected drilling parameter and produce optimum values for controllable parameters. Results from the optimizer can be stored as controllable parameter values 222 in the memory device 208.

The memory device 208 further includes a drillbot 228 that can use computer program instructions 212 to control operations of a drilling tool such as well system 100. The drillbot 228 is a can receive control signals or instructions from an actuator interface stored on the computing device 112 or another remote computing device. The drillbot 228 uses the received control signals or instructions to control operations of components of a drilling tool, such as by imitating control signals to one or more actuators of the drilling tool.

The computing device 112 includes a communication interface 206 enabling communication with other computing devices within a system of systems environment. The communication interface 206 can represent one or more components that facilitate a network connection or otherwise facilitate communication between electronic devices. Examples include, but are not limited to, wired interfaces such as Ethernet, USB, IEEE 1394, and/or wireless interfaces such as IEEE 802.11, Bluetooth, near-field communication (NFC) interfaces, RFID interfaces, or radio interfaces for accessing cellular telephone networks (e.g., transceiver/antenna for accessing a CDMA, GSM, UMTS, or other mobile communications network).

In some examples, the computing device 112 includes a user input device 224. The user input device 224 can represent one or more components used to input data. Examples of the user input device 224 can include a keyboard, mouse, touchpad, button, or touch-screen display, etc.

In some examples, the computing device 112 includes a display device 226. The display device 226 can represent one or more components used to output data. Examples of the display device 226 can include a liquid-crystal display (LCD), a television, a computer monitor, a touch-screen display, etc. In some examples, the user input device 916 and the display device 226 can be a single device, such as a touch-screen display.

Figure 3:
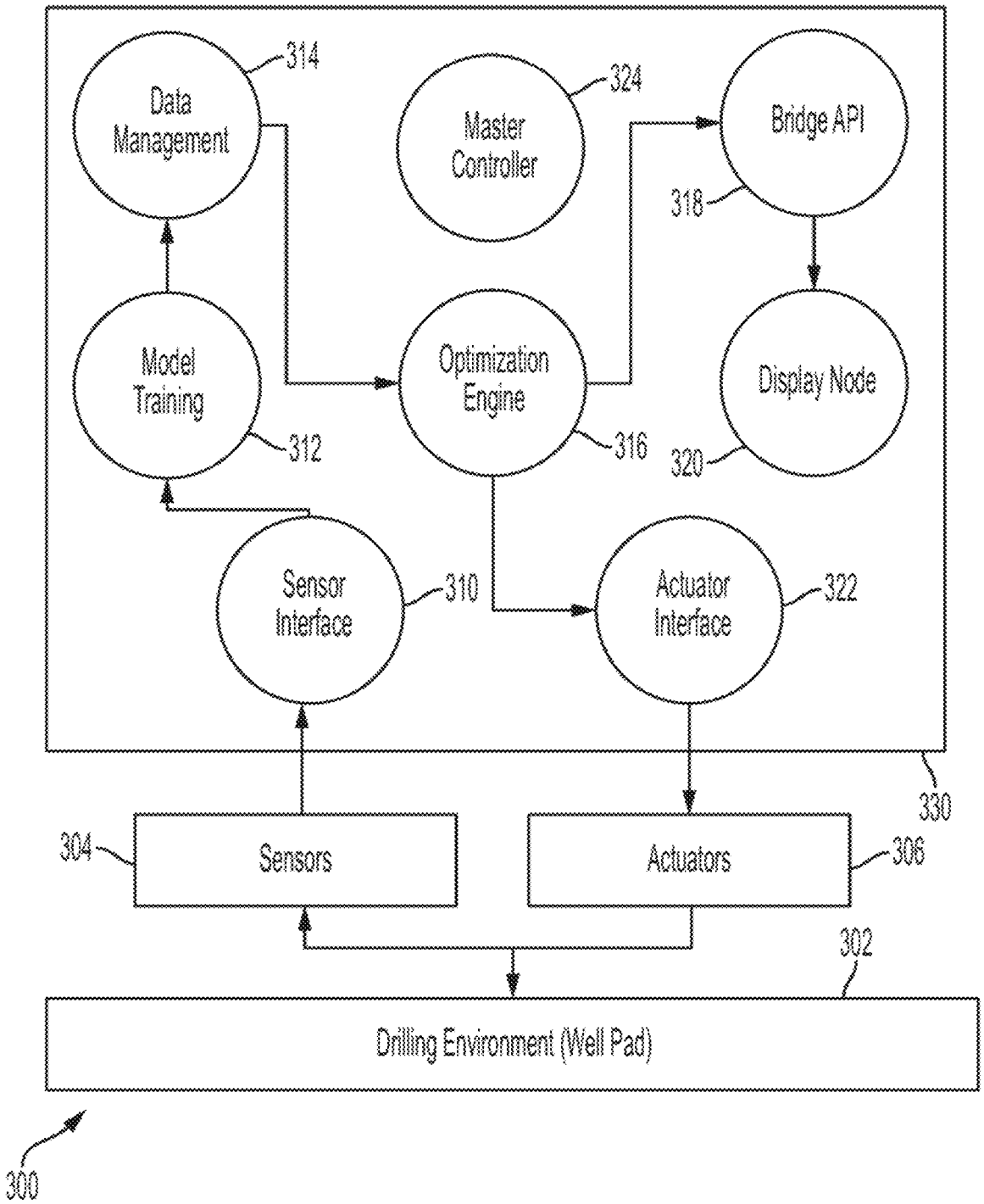
FIG. 3 is a block diagram illustrating an example of a multi-agent system of well systems capable of controlling a drilling tool according to some aspects of the disclosure.

FIG. 3 is a block diagram of a multi-agent system of well systems 300 used to optimize drilling operations based on physical environment conditions and power availability. Certain aspects of the multi-agent system of well systems 300 include multiple nodes 310-322 configured to perform various operations of the multi-agent multi-objective optimization as directed by master controller 324. The nodes 310-322 may be hosted in a distributed computing environment 330 such as a cloud computing environment or an internet of things/internet of everything (IoT/IoE) environment. One or more nodes can be hosted on any given computing device, such as computing device 112, within the distributed computing environment 330.

A drilling environment 302 such as a well pad can include a number of drilling tools such as well system 100. Each of the drilling tools is associated with or in communication with one or more sensors 304. The sensors 304 collect data relating to drill operations and communicate the observed data to a sensor interface node 310. The sensor interface node 310 collects observed values for drilling parameters at each of the drilling tools within the drilling environment 302. In various aspects, the sensors distributed throughout the drilling environment 302 can communicate their output to the same computing device, hosting the sensor interface node 310. In other aspects, the sensor interface node 310 may be hosted on multiple computing devices, which communicate with one another to organize or store the collected sensor output.

Collected sensor output or observed values, is passed to a model training node 312 to train or update an engineering model (e.g., engineering model 211) configured to predict future drilling parameter values. For example, real-time observed values for drilling parameters is used to regularly update the engineering model in order to improve the accuracy of predictions. The engineering model may be built using a variety of machine learning techniques such as deep-learning neural networks.

A data management node 314 receives observed values and obtain stored engineering constraints and power constraints. The engineering constraints can be evaluated or maintained for each drilling tool within the drilling environment. The power constraints are associated with the power capacity for the entire drilling environment 302. The observed values and the obtained engineering and power constraints are passed to an optimization engine node 316.

The optimization engine node 316 can utilize the optimizer of one or more computing devices, such as optimizer 220 of computing device 112. The optimization engine node 316 evaluates selected drilling parameters such as ROP and HMSE using the observed values as input for objective functions. For example, the ROP and HMSE may be calculated using the equations:

$$ROP=f(WOB,RPM)$$

$$HMSE=f(ROP,WOB,RPM)$$

in which the observed values include the WOB and the RPM of the drill bit. The drilling parameters ROP and HMSE are then optimized using the engineering constraints such as hole cleaning, torque, drag, and vibration.

In certain aspects, multi-objective optimization involves maximizing the ROP and minimizing the HMSE drilling parameters. An optimization for ROP may be obtained using the function:

$$ROP=K(WOB)^{a1}(RPM)^{a2}$$

in which K is a drilling constant and $a_1$ and $a_2$ are constants obtained from the engineering model. The drilling constant and $a_1$ and $a_2$ are generated using the engineering model, which may simulate real-world physics, and added to the observed values to build a hybrid model and use it for optimization. This function can enable maximization of the ROP drilling parameter. Conversely, the HMSE drilling parameter is minimized using the function:

$$HMSE=\left(\frac{WOB-\eta F}{A_b}\right)+\left(\frac{120*RPM*T+\eta*P*Q}{A_b*ROP}\right)$$

In which n is a friction coefficient, F is an impact force, T is the bit torque, P is the pressure drop across the bit, and Ab is the bit area. The optimization of the ROP and HMSE is the first level of optimization and may be specific to each drilling tool within the drilling environment.

A second stage of optimization performed by the optimization engine node 316 involves the global optimization of power distribution across the drilling environment 302. This is a system of systems level optimization that may calculate optimal power distribution to each drilling tool or clusters of drilling tools within the drilling environment 302. Each of the optimized drilling parameters can be constrained by dividing the optimized drilling parameter by the available power for the drilling tool or drilling cluster. That is, the ROP and HMSE are represented as a function of the power constraint multiplied by a proportion K for each drilling parameter.

$$ROP=K_1*Power$$

$$HMSE=K_2*Power$$

The globally optimized ROP and HMSE are passed to both a bridge API node 318 and an actuator interface node 322. The bridge API node 318 can format the optimized drilling parameters for display via a display node 320 in communication with a display of a computing device, such as display device 226.

In certain aspects, the actuator interface node 322 can communicate the optimized drilling parameters to one or more actuators 306 of drilling tools within the drilling environment. For example, a computing device hosting the actuator interface node 322 can use communication interface 206 to pass the optimized drilling parameters to each of the multiple drilling tools within the drilling environment.

Individual drilling tools use the optimized drilling parameters to modify the operations of one or more components of the drilling tool.

Figure 4:
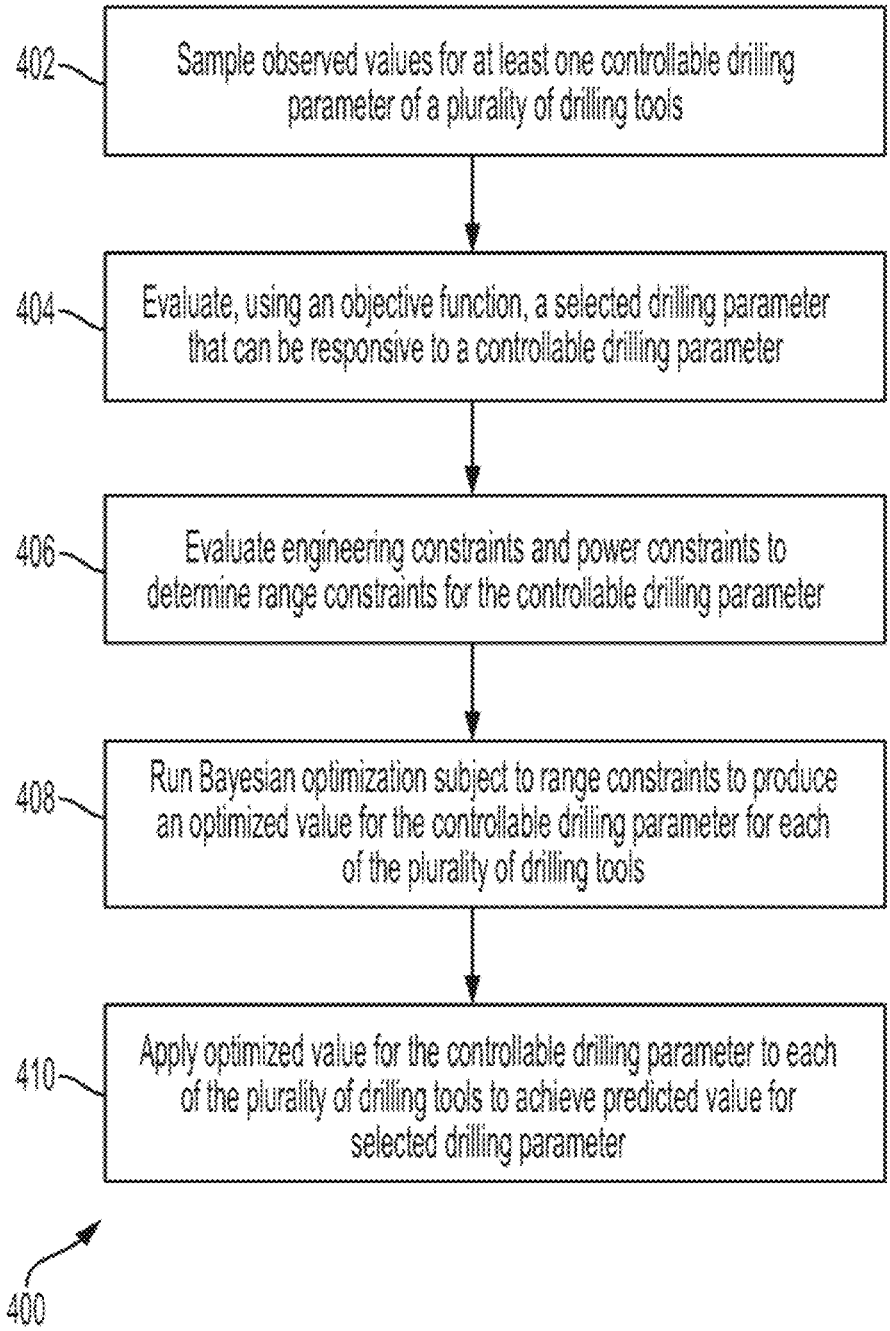
FIG. 4 is a flowchart illustrating a process for controlling multiple drilling tools in a common drilling environment according some aspects of the disclosure.

FIG. 4 is a flowchart illustrating a process 400 for controlling multiple drilling tools according some aspects. The process 400 is carried out in some aspects by computer program instructions 212 of multiple computing devices associated with multiple drilling tools within a drilling environment. At block 402 of process 400, computing device 112 begins sampling of observed values for a controllable drilling parameter or multiple controllable drilling parameters for each of a plurality of drilling tools. As an example, computing device 112 can sample these value from communication interface 116 of one or more drilling tools such as drilling tool 114.

At block 404, processing device 202 of computing device 112 evaluates a selected drilling parameter using the observed values for the controllable drilling parameters of each of the plurality of drilling paramours and an objective function. For example, selected drilling parameters can be ROP and HMSE. In some aspects, the objective function is a loss function and the loss function is maximized. At block 406, processing device 202 evaluates engineering constraints using the engineering model 211 to determine range constraints for the controllable drilling parameter or parameters of each of the plurality of drilling tools. The engineering model 211 can be supplied, as examples, through user input device 224 or communication interface 206 of computing device 112. The engineering model 211 may be stored in whole or in part on computing device 112, and may be distributed or reproduced across other computing devices associated with the plurality of drilling tools.

Range constraints are numerical values for parameters that are programmatically prohibited. Range constraints are based on physical engineering constraints, which are in turn based on physical properties of the drilling environment, which includes the drill string and formation. Engineering constraints are nonlinear. The physical properties of the drill string and formation manifest themselves, as examples, in torque and drag, whirl, and maximum pumping rate of drilling fluids. Whirl is a disruptive resonance in the drill string at certain rotational drill speeds. RPM values around these speeds must usually be avoided. Pumping rate can be a constraint because there is a maximum rate at which debris-filled fluid can be removed from the wellbore. Torque and drag restraints may be imposed by forces exerted on the drill bit by friction with the subterranean formation in which the wellbore is being formed. Some range constraints can change with the drill string configuration and the nature of the formation. For example, RPM values can change with the length and depth of the drill string.

Range constraints also include power constraints for the plurality of drilling tools. The power constraints are global and apply to the entire field or environment of drilling tools (e.g., the well pad of drilling environment 302). Conversely, the engineering constraints are associated individually with each drilling tool within the drilling environment. While some engineering constraints may apply to multiple drilling tools, there is no requirement or expectation that engineering constraints are universally applicable. Conversely, power constraints refer to the amount of power availed to support operations for all drilling tools within the drilling environment. The power constraints may be a single value characterizing available power for the entire drilling environment, or may be a set of numerical values, each associated with a cluster of drilling tools and characterizing the amount of power available for use by a respective cluster of drilling tools.

Still referring to FIG. 4, at block 408, computing device 112, using processing device 202 runs a Bayesian optimization subject to the range constraints and the observed values of controllable drilling parameters from the plurality of drilling tools to produce optimized values for the controllable drilling parameters to achieve a predicted value for the selected drilling parameter of each of the plurality of drilling tools. In some aspects, the Bayesian optimization includes setting the objective function to zero during the optimization. In some aspects, the Bayesian optimization is run using optimizer 220 of computing device 112 or an optimizer of multiple computing devices. The optimized controllable drilling parameters may be stored as controllable parameter values 222 in memory device 208. In some aspects, the Bayesian optimization uses a deep-learning neural network, for example, stored as a portion of optimizer 220 in memory device 208 of computing device 112. At block 410 of process 400, the processing device 202 applies the optimized values for the controllable drilling parameter or parameters to the respective drilling tools to achieve the predicted value for the selected drilling parameter.

In some aspects, the predicted value is produced by applying the deep-learning neural network to perform the Bayesian optimization using observed values for the controllable drilling parameter received at multiple observation times from each of the plurality of drilling tools. The predicted value of the response variable, the selected drilling parameter, can be one of a sequence of predicted values. The deep-learning neural network is taught using the observed values of controllable parameters. The deep-learning neural network can include convolutional layers that follow the relationship between the controllable parameters and the selected drilling parameter.

Figure 5:
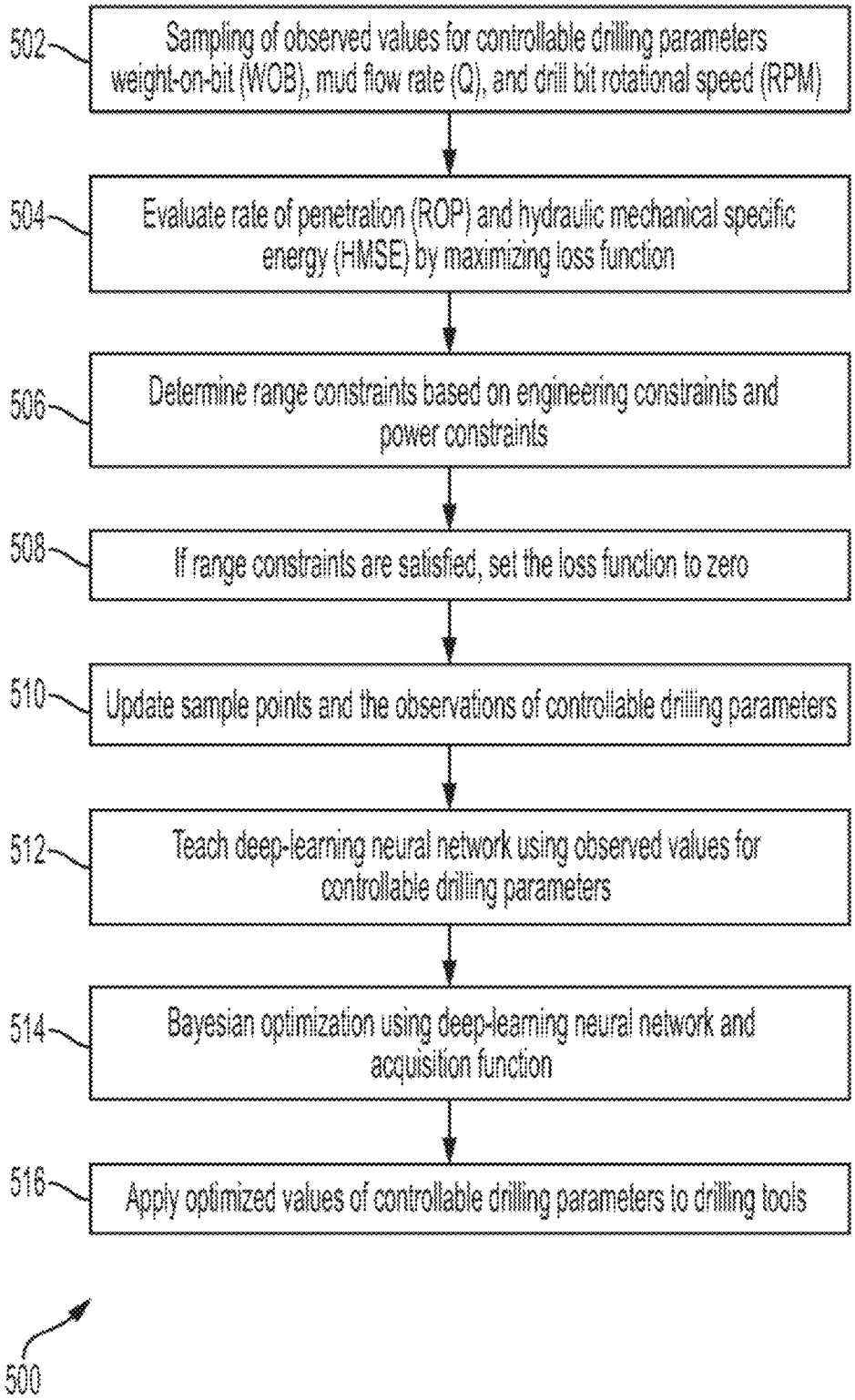
FIG. 5 is a graphical representation of a response variable space that is used in a system for controlling a drilling tool according to some aspects of the disclosure.

FIG. 5 is a flowchart illustrating a process 500 for controlling multiple drilling tools using a parameter space for a drilling environment according to some aspects. At block 502 of process 500, for each of a number of observations, values for WOB and RPM are sampled. At block 504, the drilling parameter, ROP in this example, is evaluated by maximizing the objective function using the observed values for WOB and RPM. Conversely, the HMSE is evaluated by minimizing the objective function.

At block 506, range constraints including engineering constraints for WOB and RPM and power constraints for the entire drilling environment are determined. Blocks 508, 510, 512, and 514 detail an example of running the Bayesian optimization of block 408 of FIG. 4 using computer program instructions 212 and optimizer 220 of computing device 112. Inputs to optimizer 220 are the WOB and RPM for each of a plurality of drilling tools, the engineering constraints for each drilling tool or cluster of drilling tools, and the power constraints on the entire drilling environment (e.g., the system of systems). At block 508, when the range constraints are satisfied, the processing device 202 sets a loss function to zero. At block 510, sample points and observed values for WOB and RPM are updated. At block 512, the deep-learning neural network of optimizer 220 is taught using the updated observed values for the controllable drilling parameters WOB and RPM, and the values are optimized at block 514 using Bayesian optimization with an acquisition function. At block 516, the optimized values for WOB and RPM are applied to the drilling tool to achieve a predicted, optimized value for ROP and HMSE.

Figure 6:
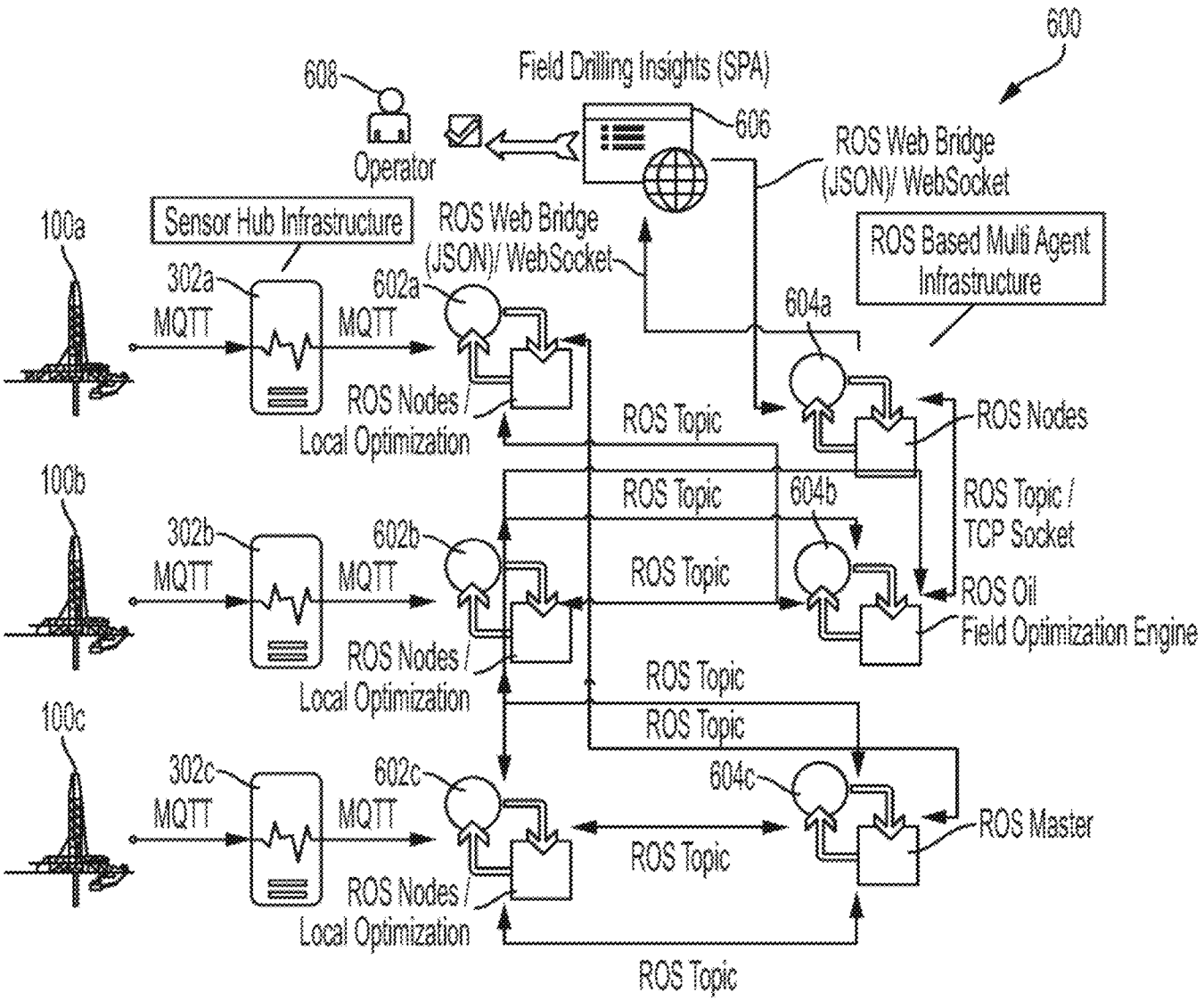
FIG. 6 is a block diagram illustrating an example of a robotic operations system (ROS) within a system of well systems that is capable of controlling a drilling tool according to some aspects of the disclosure.

FIG. 6 is a graphical representation of an ROS in a system of well systems 600. The system of well systems 600 can include a number of drilling tools such as well systems 100*a*-100*c*. The drilling tools can be individually controlled by a drill bot (e.g., drillbot 228 of computing device 112) or controlled in a cluster such that one drillbot is configured to control the operations of a cluster of drilling tools. Sensors 302*a*-302*c* collect data at each of the drilling tools and communicates sensor output to nodes 602*a*-604*c* of the system of well systems 600.

Certain aspects include a collection of ROS nodes 602*a*-602*c* configured to perform local optimization of drilling tool operations. For example, some or all of the nodes 310-322 of FIG. 3 may be included in ROS nodes 602*a*-602*c* for local optimization. These nodes may receive sensor output related to torque, drag, whirl, pumping area, bit area, friction, pressure drop across the bit, WOB, and RPM, and may use these values to evaluate the ROP and HMSE for each drilling tool. The ROS nodes 602*a*-602*c* can implement the functions described with reference to FIG. 3 to optimize the HMSE and ROP using the observed values of sensor output and engineering constraints on the drilling tools individually or in clusters.

Optimized ROP and HMSE values are communicated to field ROS nodes 604*a*-604*c*, which can be implemented using some or all of the nodes 310-322 described in FIG. 3. The locally optimized ROP and HMSE values can be further optimized based on power constraints. The power constraints are a representation of the power available to the entire system of well systems 600. The result of power constraint optimization can be a reduction in ROP and HMSE proportional to the power available for an implementing drilling tool. Field optimized ROP and HMSE are communicated back to the drilling tools, such as well systems 100*a*-100*c* for implementation. Field optimized parameters are also communicated via a bridge interface, such as a web interface to a field insights application 606 for review by an operator 608. The web interface between the operator computing device and the system of well systems 600 can be implemented using bridge API node 318 of FIG. 3.

Figure 7:
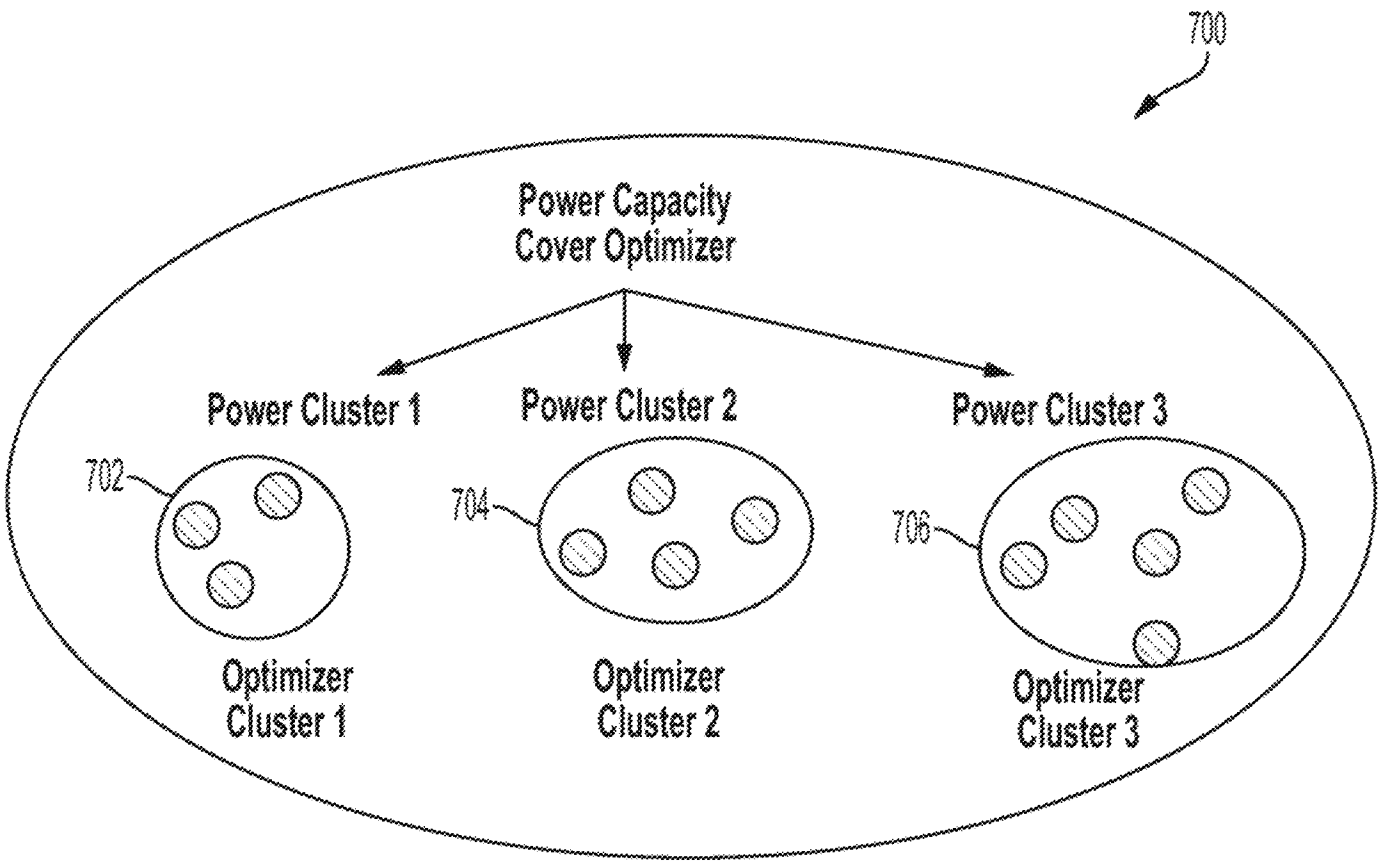
FIG. 7 is a block diagram illustrating an example of a multi-agent multi-objective optimization system on a robotic operations system (ROS) that is capable of controlling a drilling tool according to some aspects of the disclosure.

FIG. 7 is a graphical representation of a multi-agent multi-objective optimization system 700 operating on an ROS. The optimization system 700 is a field optimization system in which drilling tools are organized by power clusters 702-706. Power available to the entire system is divided amongst power clusters including multiple drilling tools that share the same power cluster resources but not those resources of other power clusters. For example, one well pad may share power resources amongst well systems, but may not exchange, siphon, or donate power resources to another well pad.

In this example, field optimization based on power constraints is performed on each power cluster. Each drilling tool within a power cluster will have its ROP and HMSE local optimized, but these optimized drilling parameters will be field optimized according to the amount of power available to the cluster. Power clusters associated with more productive drilling tools may receive a larger of the overall power resources of the optimization system 700, and thus the ROP and HMSE of drilling tools within such a cluster may not need to be reduced, or may experience only marginal modification. Conversely, less productive regions of a drilling environment or those regions with fewer drilling tools, may receive a smaller proportion of overall power resources, resulting in greater modification of the optimized drilling parameters during field optimization.

Certain aspects thus enable an operator such as operator 608 of FIG. 6 to customize the power resources available to different regions of a drilling environment according to productivity, time, date, and other factors.

Unless specifically stated otherwise, it is appreciated that throughout this specification that terms such as "processing," "calculating," "determining," "operations," or the like refer to actions or processes of a computing device, such as the controller or processing device described herein, that can manipulate or transform data represented as physical electronic or magnetic quantities within memories, registers, or other information storage devices, transmission devices, or display devices. The order of the process blocks presented in the examples above can be varied, for example, blocks can be re-ordered, combined, or broken into sub-blocks. Certain blocks or processes can be performed in parallel. The use of "configured to" herein is meant as open and inclusive language that does not foreclose devices configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Elements that are described as "connected," "connectable," or with similar terms can be connected directly or through intervening elements.

In some aspects, systems and methods for controlling range constraints for real-time drilling are provided according to one or more of the following examples. As used below, any reference to a series of examples is to be understood as a reference to each of those examples disjunctively (e.g., "Examples 1-4" is to be understood as "Examples 1, 2, 3, or 4").

In Example 1, a system can include a plurality of drilling tools, and a computing device in communication with the plurality of drilling tools, the computing device including a non-transitory memory device comprising instructions that are executable by the computing device to cause the computing device to perform operations including sampling observed values for at least one controllable drilling parameter at each of the plurality of drilling tools, determining range constraints based on physical properties of a drilling environment for each of the plurality of drilling tools and available power for the plurality of drilling tools, executing a Bayesian optimization subject to the range constraints and the observed values to produce an optimized value for the at least one controllable drilling parameter to achieve a predicted value for the controllable drilling parameter for each of the plurality of drilling tools, and controlling each of the plurality of drilling tools using the optimized value for the at least one controllable drilling parameter for each respective drilling tool of the plurality of drilling tools to achieve the predicted value for the controllable drilling parameter.

Example 2 includes the system of Example 1 wherein the operations further includes teaching a deep-learning neural network using the observed values, and running the Bayesian optimization using the deep-learning neural network.

Example 3 includes the system of either of Examples 1 and 2, wherein the operations for executing a Bayesian optimization subject to the range constraints and the observed values to produce an optimized value for the at least one controllable drilling parameter further include executing a first function on the observed values and the physical properties of a drilling environment for each of the plurality of drilling tools to produce a local value, and executing a field optimization function on the local value and the available power for the plurality of drilling tools to produce the optimized value.

Example 4 includes the system of Example 3, wherein the first function is a local optimization function.

Example 5 includes the system of any of Examples 1-4, wherein the system comprises a plurality of well systems.

Example 6 includes the system of any of Example 1-5, wherein the controllable drilling parameter comprises rate-of-penetration and the at least one controllable drilling parameter comprises at least one of weight-on-bit or drill bit rotational speed or mud flow rate (Q).

Example 7 includes the system of any of Examples 1-6 wherein the controllable drilling parameter comprises hydraulic mechanical specific energy and the at least one controllable drilling parameter includes at least one of weight-on-bit or drill bit rotational speed or mud flow rate.

Example 8 is a method having operations including sampling observed values for at least one controllable drilling parameter at each of a plurality of drilling tools, determining range constraints based on physical properties of a drilling environment for each of the plurality of drilling tools and available power for the plurality of drilling tools, executing a Bayesian optimization subject to the range constraints and the observed values to produce an optimized value for the at least one controllable drilling parameter to achieve a predicted value for the controllable drilling parameter for each of the plurality of drilling tools, and controlling each of the plurality of drilling tools using the optimized value for the at least one controllable drilling parameter for each respective drilling tool of the plurality of drilling tools to achieve the predicted value for the controllable drilling parameter.

Example 9 includes the method of Example 8 further including teaching a deep-learning neural network using the observed values, and running the Bayesian optimization using the deep-learning neural network.

Example 10 includes the method of either of Examples 8 or 9 wherein executing a Bayesian optimization subject to the range constraints and the observed values to produce an optimized value for the at least one controllable drilling parameter further include executing a first function on the observed values and the physical properties of a drilling environment for each of the plurality of drilling tools to produce a local value, and executing a field optimization function on the local value and the available power for the plurality of drilling tools to produce the optimized value.

Example 11 includes the method of Example 10 wherein the first function is a local optimization function.

Example 12 includes the methods of c any of Examples 8-11 wherein the method is performed by a plurality of well systems.

Example 13 includes the methods of any of Examples 8-12 wherein the controllable drilling parameter includes rate-of-penetration and the at least one controllable drilling parameter comprises at least one of weight-on-bit or drill bit rotational speed or mud flow rate.

Example 14 includes the method of any of Examples 8-13 wherein the controllable drilling parameter includes hydraulic mechanical specific energy and the at least one controllable drilling parameter comprises at least one of weight-on-bit or drill bit rotational speed or mud flow rate.

Example 15 is a non-transitory computer-readable medium that includes instructions that are executable by a processing device for causing the processing device to perform a method including sampling observed values for at least one controllable drilling parameter at each of a plurality of drilling tools, determining range constraints based on physical properties of a drilling environment for each of the plurality of drilling tools and available power for the plurality of drilling tools, executing a Bayesian optimization subject to the range constraints and the observed values to produce an optimized value for the at least one controllable drilling parameter to achieve a predicted value for the controllable drilling parameter for each of the plurality of drilling tools, and controlling each of the plurality of drilling tools using the optimized value for the at least one controllable drilling parameter for each respective drilling tool of the plurality of drilling tools to achieve the predicted value for the controllable drilling parameter.

Example 16 includes the non-transitory computer-readable medium of Example 15 wherein the method further includes teaching a deep-learning neural network using the observed values, and running the Bayesian optimization using the deep-learning neural network.

Example 17 includes the non-transitory computer-readable medium of any of Examples 15-16 wherein executing a Bayesian optimization subject to the range constraints and the observed values to produce an optimized value for the at least one controllable drilling parameter further includes executing a first function on the observed values and the physical properties of a drilling environment for each of the plurality of drilling tools to produce a local value, and executing a field optimization function on the local value and the available power for the plurality of drilling tools to produce the optimized value.

Example 18 includes the non-transitory computer-readable medium of Example 17, wherein the first function is a local optimization function.

Example 19 includes the non-transitory computer-readable medium of any of Examples 15-18 wherein the non-transitory computer-readable medium is part of a system of well systems.

Example 20 includes the non-transitory computer-readable medium of any of Examples 15-19 wherein the controllable drilling parameter comprises one or more of rate-of-penetration or hydraulic mechanical specific energy and the at least one controllable drilling parameter comprises at least one of weight-on-bit or drill bit rotational speed or mud flow rate.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a plurality of drilling tools distributed among a plurality of well systems to form a plurality of wellbores; and a computing device in communication with the plurality of drilling tools, the computing device including a non-transitory memory device comprising instructions that are executable by the computing device to cause the computing device to perform operations comprising:

sampling observed values for at least one controllable drilling parameter at each drilling tool of the plurality of drilling tools;

determining range constraints based on physical properties of a drilling environment for each drilling tool of the plurality of drilling tools and available power for the plurality of drilling tools, the determining comprising, for each drilling tool of the plurality of drilling tools:

maximizing a rate-of-penetration based on weight-on-bit, rotations-per-minute, and a plurality of constants determined by an engineering model; and minimizing hydraulic mechanical specific energy based on weight-on-bit, rotations-per-minute, friction, impact force, torque, pressure, and area;

executing a Bayesian optimization subject to the range constraints and the observed values to produce an optimized value for the at least one controllable drilling parameter to achieve a predicted value for a separate controllable drilling parameter for each drilling tool of the plurality of drilling tools; and forming at least a portion of a wellbore of the plurality of wellbores by controlling each drilling tool of the plurality of drilling tools using the optimized value for the at least one controllable drilling parameter for each respective drilling tool of the plurality of drilling tools to achieve the predicted value for the separate controllable drilling parameter, wherein the controlling comprises updating an operational parameter of the respective drilling tool to the optimized value to achieve the predicted value.

2. The system of claim 1 wherein the operations further comprise:

teaching a deep-learning neural network using the observed values; and running the Bayesian optimization using the deep-learning neural network.

3. The system of claim 1 wherein the operations for executing a Bayesian optimization subject to the range constraints and the observed values to produce an optimized value for the at least one controllable drilling parameter further comprise: executing a first function on the observed values and the physical properties of a drilling environment for each of the plurality of drilling tools to produce a local value; and executing a field optimization function on the local value and the available power for the plurality of drilling tools to produce the optimized value.

4. The system of claim 3, wherein the first function is a local optimization function.

5. The system of claim 1 wherein the separate controllable drilling parameter comprises rate-of-penetration and the at least one controllable drilling parameter comprises at least one of weight-on-bit or drill bit rotational speed or mud flow rate.

6. The system of claim 1 wherein the separate controllable drilling parameter comprises hydraulic mechanical specific energy and the at least one controllable drilling parameter comprises at least one of weight-on-bit or drill bit rotational speed or mud flow rate.

7. The system of claim 1, wherein the operation of determining the range constraints comprises, for the plurality of drilling tools as-a-whole, using the maximized rate-of-penetration and the minimized hydraulic mechanical specific energy to determine an optimized power distribution among the plurality of drilling tools.

8. A method comprising:

sampling observed values for at least one controllable drilling parameter at each drilling tool of a plurality of drilling tools distributed among a plurality of well systems to form a plurality of wellbores;

determining range constraints based on physical properties of a drilling environment for each drilling tool of the plurality of drilling tools and available power for the plurality of drilling tools, the determining comprising, for each drilling tool of the plurality of drilling tools:

maximizing a rate-of-penetration based on weight-on-bit, rotations-per-minute, and a plurality of constants determined by an engineering model; and minimizing hydraulic mechanical specific energy based on weight-on-bit, rotations-per-minute, friction, impact force, torque, pressure, and area;

executing a Bayesian optimization subject to the range constraints and the observed values to produce an optimized value for the at least one controllable drilling parameter to achieve a predicted value for a separate controllable drilling parameter for each drilling tool of the plurality of drilling tools; and forming at least a portion of a wellbore of the plurality of wellbores by controlling each drilling tool of the plurality of drilling tools using the optimized value for the at least one controllable drilling parameter for each respective drilling tool of the plurality of drilling tools to achieve the predicted value for the separate controllable drilling parameter, wherein the controlling comprises updating an operational parameter of the respective drilling tool to the optimized value to achieve the predicted value.

9. The method of claim 8 further comprising:

teaching a deep-learning neural network using the observed values; and running the Bayesian optimization using the deep-learning neural network.

10. The method of claim 8 wherein executing a Bayesian optimization subject to the range constraints and the observed values to produce an optimized value for the at least one controllable drilling parameter further comprises: executing a first function on the observed values and the physical properties of a drilling environment for each of the plurality of drilling tools to produce a local value; and executing a field optimization function on the local value and the available power for the plurality of drilling tools to produce the optimized value.

11. The method of claim 10, wherein the first function is a local optimization function.

12. The method of claim 8 wherein the separate controllable drilling parameter comprises rate-of-penetration and the at least one controllable drilling parameter comprises at least one of weight-on-bit or drill bit rotational speed or mud flow rate.

13. The method of claim 8 wherein the separate controllable drilling parameter comprises hydraulic mechanical specific energy and the at least one controllable drilling parameter comprises at least one of weight-on-bit or drill bit rotational speed or mud flow rate.

14. A non-transitory computer-readable medium that includes instructions that are executable by a processing device for causing the processing device to perform operations comprising:

sampling observed values for at least one controllable drilling parameter at each drilling tool of a plurality of drilling tools distributed among a plurality of well systems to form a plurality of wellbores;

determining range constraints based on physical properties of a drilling environment for each drilling tool of the plurality of drilling tools and available power for the plurality of drilling tools, the determining comprising, for each drilling tool of the plurality of drilling tools:

maximizing a rate-of-penetration based on weight-on-bit, rotations-per-minute, and a plurality of constants determined by an engineering model; and minimizing hydraulic mechanical specific energy based on weight-on-bit, rotations-per-minute, friction, impact force, torque, pressure, and area;

executing a Bayesian optimization subject to the range constraints and the observed values to produce an optimized value for the at least one controllable drilling parameter to achieve a predicted value for a separate controllable drilling parameter for each drilling tool of the plurality of drilling tools; and forming at least a portion of one wellbore of the plurality of wellbores by controlling each drilling tool of the plurality of drilling tools using the optimized value for the at least one controllable drilling parameter for each respective drilling tool of the plurality of drilling tools to achieve the predicted value for the separate controllable drilling parameter, wherein the controlling comprises updating an operational parameter of the respective drilling tool to the optimized value to achieve the predicted value.

15. The non-transitory computer-readable medium of claim 14 wherein the operations further comprise:

teaching a deep-learning neural network using the observed values; and running the Bayesian optimization using the deep-learning neural network.

16. The non-transitory computer-readable medium of claim 14 wherein executing a Bayesian optimization subject to the range constraints and the observed values to produce an optimized value for the at least one controllable drilling parameter further comprises:

executing a first function on the observed values and the physical properties of a drilling environment for each of the plurality of drilling tools to produce a local value; and executing a field optimization function on the local value and the available power for the plurality of drilling tools to produce the optimized value.

17. The non-transitory computer-readable medium of claim 16, wherein the first function is a local optimization function.

18. The non-transitory computer-readable medium of claim 14 wherein the separate controllable drilling parameter comprises one or more of rate-of-penetration or hydraulic mechanical specific energy and the at least one controllable drilling parameter comprises at least one of weight-on-bit or drill bit rotational speed or mud flow rate.

* * * * *